US009887491B2

(12) United States Patent
Matsuura et al.

(10) Patent No.: US 9,887,491 B2
(45) Date of Patent: Feb. 6, 2018

(54) LEVER-TYPE CONNECTOR

(71) Applicant: Sumitomo Wiring Systems, Ltd., Yokkaichi, Mie (JP)

(72) Inventors: Masahito Matsuura, Mie (JP); Kazuaki Takeda, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 49 days.

(21) Appl. No.: 15/044,198

(22) Filed: Feb. 16, 2016

(65) Prior Publication Data

US 2016/0240969 A1 Aug. 18, 2016

(30) Foreign Application Priority Data

Feb. 16, 2015 (JP) ..... 2015-027173

(51) Int. Cl.
*H01R 13/62* (2006.01)
*H01R 13/629* (2006.01)

(52) U.S. Cl.
CPC ..... *H01R 13/62938* (2013.01)

(58) Field of Classification Search
USPC ..... 439/157
See application file for complete search history.

(56) References Cited

U.S. PATENT DOCUMENTS 5,230,635 A * 7/1993 Takenouchi ..... H01R 13/62938 439/153
5,562,465 A * 10/1996 Taguchi ..... H01R 13/62933 439/157
6,312,273 B1 * 11/2001 Hasegawa ..... H01R 13/62933 439/153
6,695,631 B2 * 2/2004 Hamai ..... H01R 13/62938 439/157
6,942,504 B2 * 9/2005 Shinozaki ..... H01R 13/62938 439/157
7,300,294 B2 * 11/2007 Fukatsu ..... H01R 13/62955 439/157
7,410,374 B2 * 8/2008 Okuda ..... H01R 13/62955 439/157
7,445,474 B2 * 11/2008 Sakatani ..... H01R 13/62938 439/157
8,133,065 B2 * 3/2012 Horiuchi ..... H01R 13/62938 439/157

(Continued)

*Primary Examiner* — Amy Cohen Johnson
*Assistant Examiner* — Milagros Jeancharles
(74) *Attorney, Agent, or Firm* — Gerald E. Hespos; Michael J. Porco; Matthew T. Hespos

(57) ABSTRACT

A lever-type connector (C) has an initial lock (L) that is released to enable rotation of a lever (10) when the connector (C) is connected lightly to a mating connector (30) and the connector (C) is connected properly to the mating connector (30) by rotating the lever (10) from an initial position to a connection end position. The lever (10) and a housing (20) have rotation regulating portions (S) spaced from the initial lock (L) and configured to contact each other in a rotating direction of the lever (10) when the lever (10) is at the initial position for regulating rotation of the lever (10). An abutting portion (19) is provided near the entrance of a cam groove (11) and abuts against a cam pin (34) if the housing (20) is pushed in a connecting direction to the mating connector (30) when the lever (10) is at the initial position.

8 Claims, 9 Drawing Sheets

(56) References Cited

U.S. PATENT DOCUMENTS

| | | | | |
|---|---|---|---|---|
| 9,153,910 | B2 * | 10/2015 | Aoki | H01R 13/629 |
| 9,306,330 | B2 * | 4/2016 | Kuroda | H01R 13/56 |
| 2003/0017026 | A1 * | 1/2003 | Tachi | H01R 13/62938 411/157 |
| 2008/0102668 | A1 * | 5/2008 | Ikeya | H01R 13/62938 439/157 |
| 2010/0048053 | A1 * | 2/2010 | Tonosaki | H01R 13/62938 439/299 |
| 2011/0230106 | A1 * | 9/2011 | Shamoto | H01R 13/506 439/892 |
| 2012/0318645 | A1 * | 12/2012 | Kobayashi | H01H 9/0066 200/50.01 |
| 2016/0261069 | A1 * | 9/2016 | Noro | H01R 13/62955 |

* cited by examiner

LEVER-TYPE CONNECTOR

BACKGROUND

1. Field of the Invention

The invention relates to a lever-type connector.

2. Description of the Related Art

U.S. Pat. No. 6,942,504 discloses a connector that utilizes a lever to generate a cam action that reduces a connecting force. The lever is mounted rotatably on a housing of the connector and has a cam groove that engages a cam pin on a mating connector. An initial lock holds the lever at an initial position, but is released when the lever-type connector is connected lightly to the mating connector so that the lever can be rotated. Rotating the lever from the initial position to a connection end position pulls the connector toward the mating connector to reach a properly connected state.

The housing of the above-described connector may be pushed farther in a connecting direction after the lever-type connector is connected lightly to the mating connector to release the initial lock. Thus, the housing may move slightly forward and the lever may rotate slightly even though the lever is not operated. Then, an operator may misunderstand that a connecting operation to the mating connector has been completed and the connector may be left incompletely connected.

The invention was completed based on the above situation and aims to provide a lever-type connector capable of avoiding misunderstanding that a connecting operation to a mating connector has been completed.

SUMMARY

The invention is directed to a lever-type connector with a lever including a cam groove to be engaged with a cam pin provided on a mating connector. The connector has a housing and the lever is mounted rotatably thereon. An initial lock holds the lever at an initial position. However, the initial lock is released to enable a rotating operation of the lever when the lever-type connector is connected temporarily to the mating connector. The lever-type connector is connected properly to the mating connector by rotating the lever from the initial position to a connection end position. The lever and the housing have rotation regulating portions provided separately from the initial lock. The rotation regulating portions regulate the rotation of the lever by being held in contact with each other in a rotating direction of the lever when the lever is at the initial position. An abutting portion is provided near an entrance of the cam groove and abuts against the cam pin if the housing is pushed in a connecting direction to the mating connector when the lever is at the initial position. This engagement of the abutting portion of the cam groove against the cam pin prevents the housing from being pushed to the mating connector. Thus, the rotation of the lever is regulated by the rotation regulating portions, and an operator cannot mistakenly assume that a connecting operation to the mating connector has been completed.

The lever-type connector may be such that the lever slightly rotates accompanying the release of the initial lock. The rotation regulating portions are separated when the initial lock is activated and contact each other after the rotation of the lever accompanying the release of the initial lock. Accordingly, a rotational force of the lever that accompanies the release of the initial lock will not act on the rotation regulating portions.

The rotation regulating portion on the housing or on the lever may be displaced resiliently by an increase of a contact force by the rotating operation of the lever, thereby releasing a state where the rotation of the lever is regulated. Accordingly, the state where the rotation of the lever is regulated is released by an increase of a force for rotating the lever. Thus, this releasing operation and the lever rotating operation can be performed as a series of operations.

DETAILED DESCRIPTION

Figure 1:
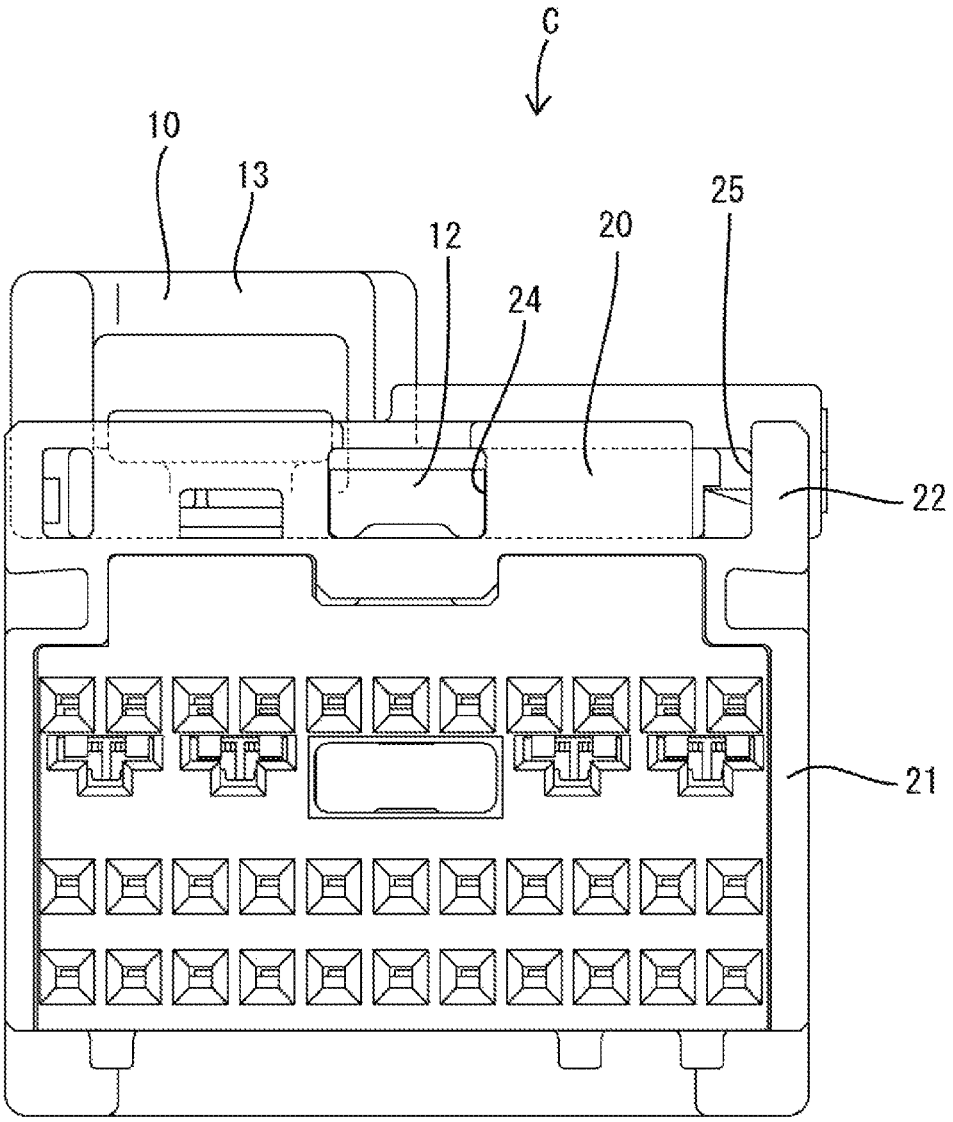
FIG. 1 is a front view showing a connector in an embodiment.

One embodiment is described in detail with reference to FIGS. 1 to 9. A connector C in this embodiment is a lever-type connector that can be connected to and separated from a mating connector 30 by rotating a lever 10. A connection surface of each member is referred to herein as a front, and upper and lower sides in FIG. 1 are referred to as the top and bottom.

Figure 3:
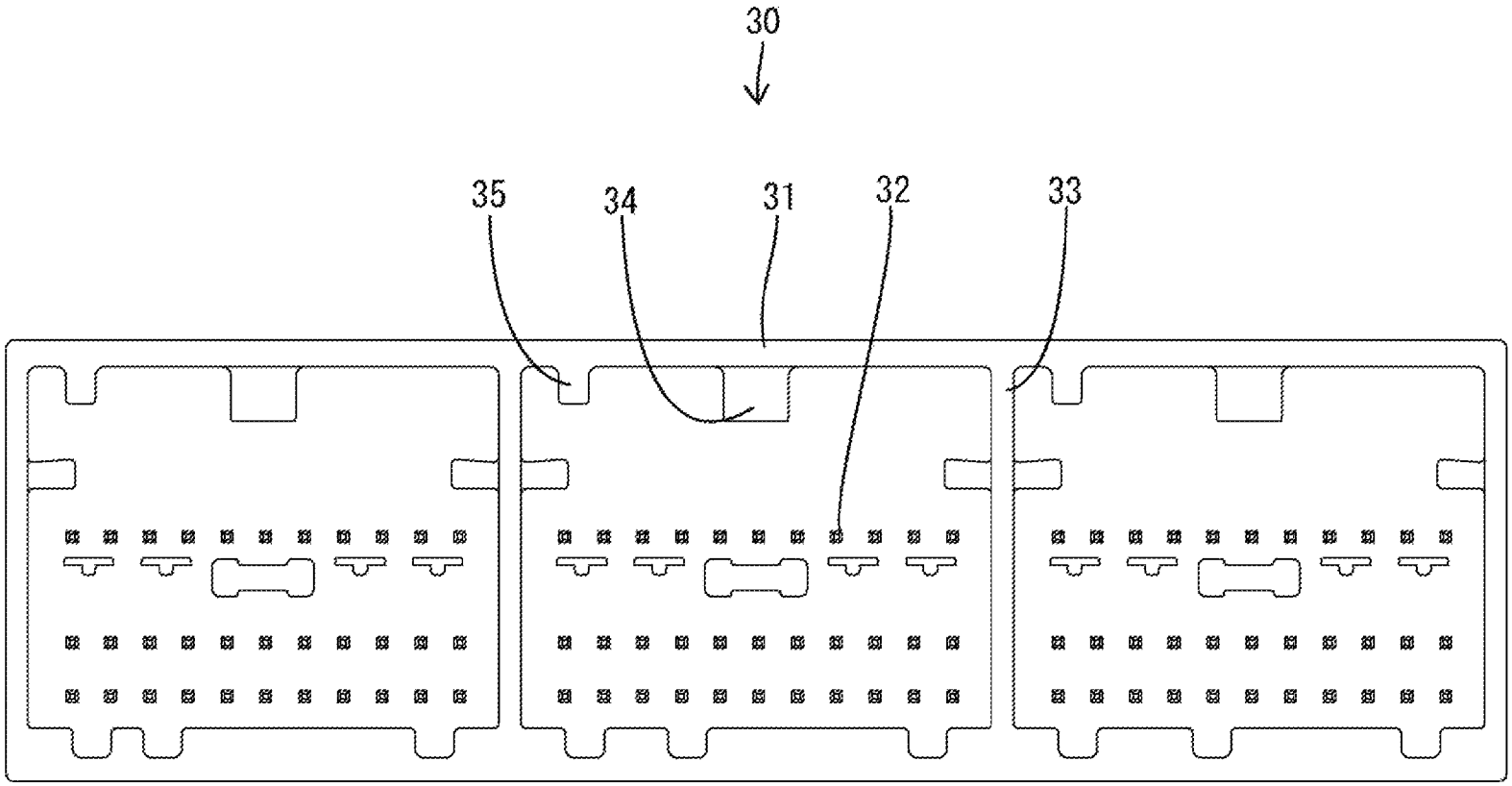
FIG. 3 is a front view showing a mating connector.

The mating connector 30 is a board connector to be fixed to a board and includes a mating housing 31 made of synthetic resin and a plurality of mating male terminal fittings 32. As shown in FIG. 3, the mating housing 31 has forwardly open receptacles 33, and the connector C is fit into each of the receptacles 33. The receptacles 33 are provided side by side in a lateral direction as shown in FIG. 3. The mating terminal fittings 32 are mounted so that tip parts thereof project into each receptacle 33.

A cylindrical cam pin 34 projects down from the upper wall of each receptacle 33 and toward an inner space of the receptacle 33. The cam pin 34 is provided substantially in a center in a front-back direction of the receptacle 33.

Figure 7:
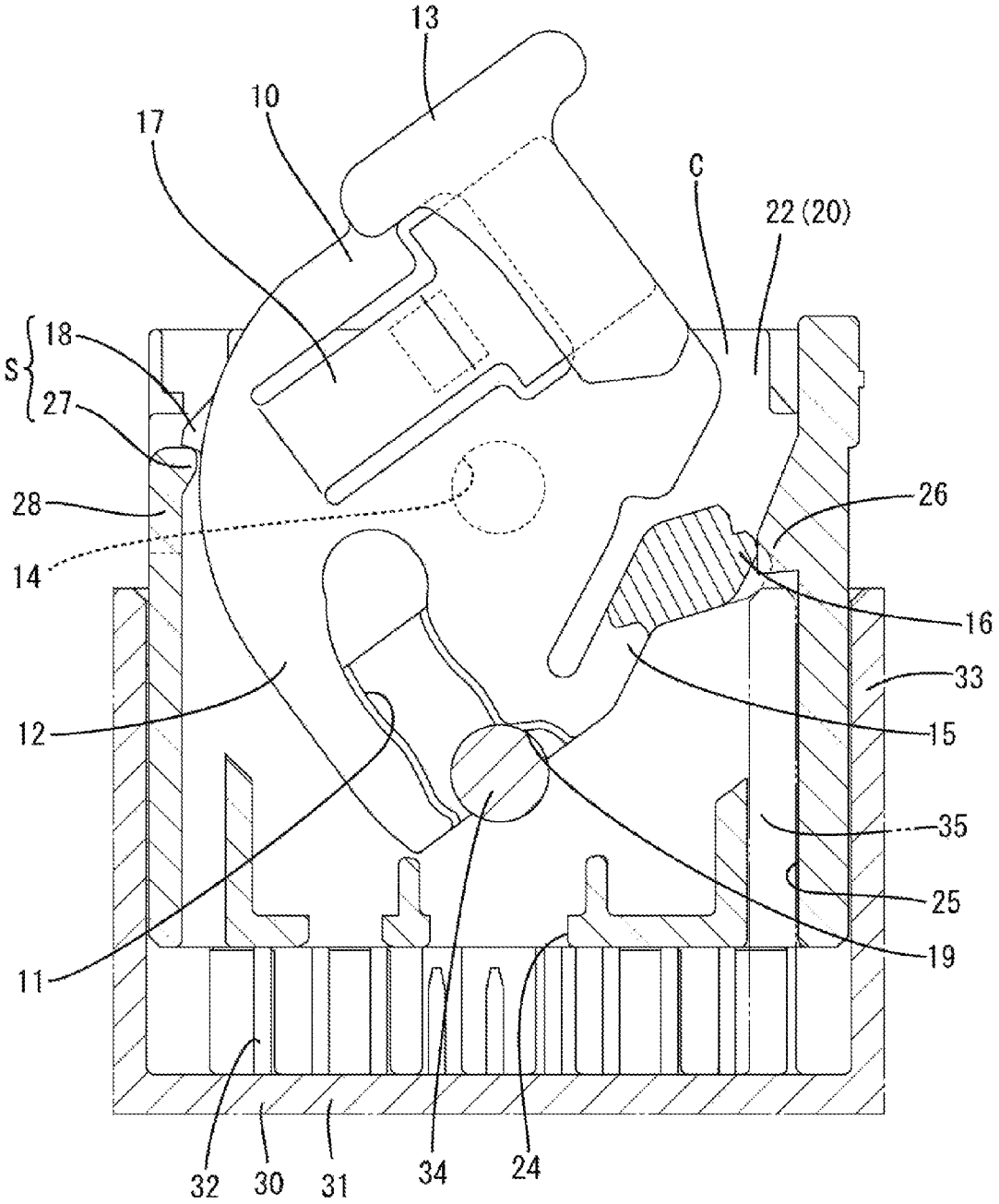
FIG. 7 is a plan view partly in section of the connector showing a state where the connector is lightly connected to the mating connector to release the initial lock.
Figure 8:
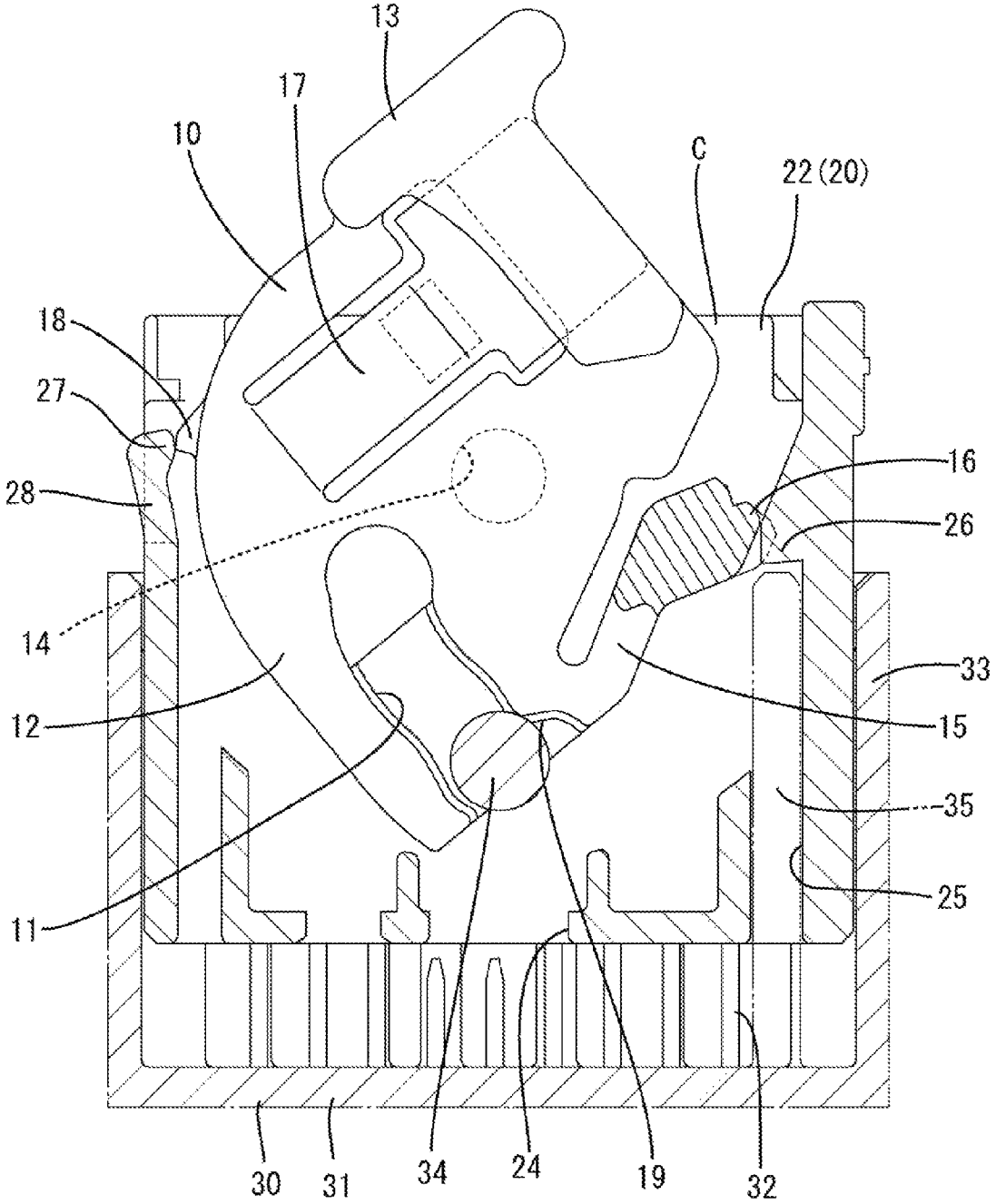
FIG. 8 is a plan view partly in section of the connector showing a state where a rotation regulating state of rotation regulating portions is released.

A lock releasing portion 35 projects down from the upper wall of each receptacle 33, as shown in FIG. 3, for releasing an initial lock L of the lever 10. As shown in FIGS. 7 and 8, the lock releasing portion 35 extends straight in the front-back direction from the front end to the rear end of the receptacle 33.

Figure 6:
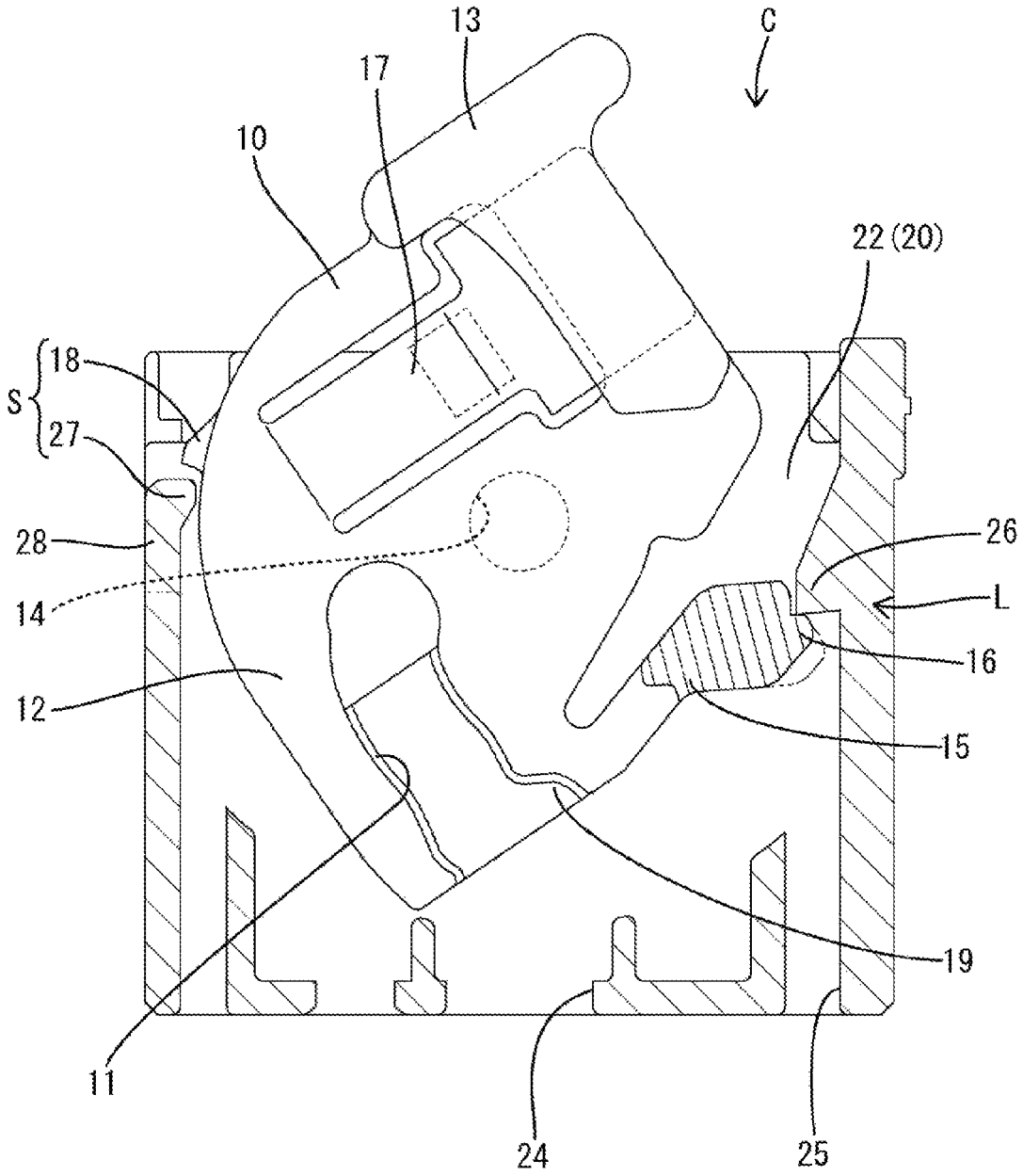
FIG. 6 is a plan view partly in section of the connector where an initial lock is activated.

As shown in FIG. 6, the connector C has the lever 10 and a housing 20. The lever 10 includes a cam groove 11 to be engaged with the cam pin 34 on the mating connector 30. The housing 20 has the lever 10 rotatably mounted thereon and the initial lock L for holding the lever 10 at an initial position. The lock releasing portion 35 releases the initial lock L to enable a rotation of the lever 10 when the connector C is connected lightly to the mating connector 30. The lever 10 then is rotated from the initial position to a connection end position and pulls the connector C toward the mating connector 30 to reach a properly connected state.

Figure 2:
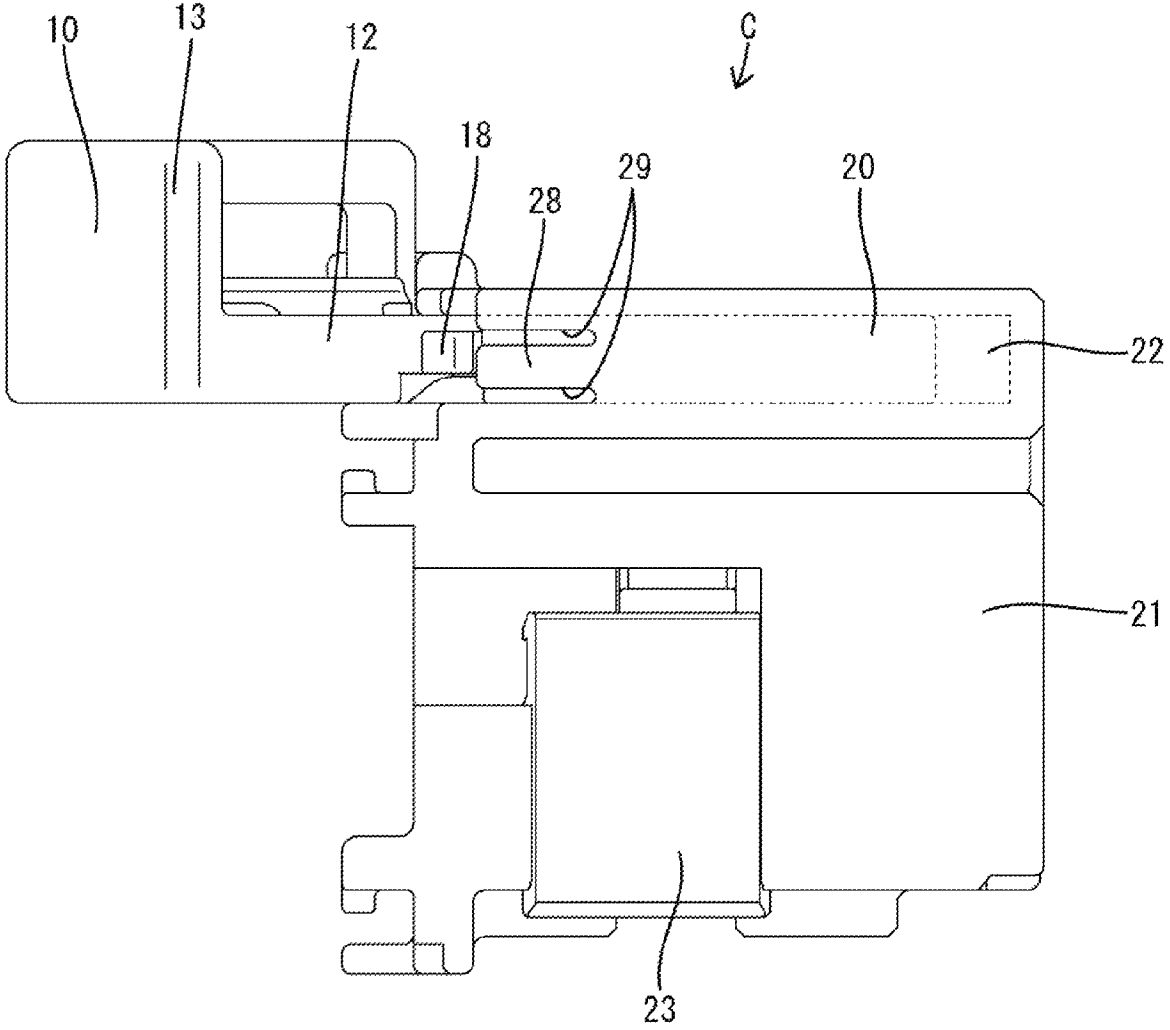
FIG. 2 is a side view showing the connector.

The housing 20 is made of synthetic resin, and, as shown in FIG. 1, is formed into a substantially rectangular block shape for fitting into the receptacle 33 of the mating housing 31. The housing 20 includes a terminal accommodating portion 21 for accommodating unillustrated terminal fittings and a lever accommodating portion 22 for accommodating the lever 10. As shown in FIG. 2, the terminal accommodating portion 21 includes a retainer 23 for locking the terminal fittings.

The lever accommodating portion 22 is open backward so that the lever 10 can be assembled from behind. The lever accommodating portion 22 is sized to spread over substantially the entire upper surface of the first housing 12, as shown in FIGS. 6 to 9.

As shown in FIG. 7, the lever accommodating portion 22 has a first receiving path 24 for receiving the cam pin 34 of the mating connector 30 from the front and a second receiving path 25 for receiving the lock releasing portion 35 from the front. The first receiving path 24 is located in a substantially central part of the housing 20 in a width direction and the second receiving path 25 is located on one side of the housing 20 in the width direction.

Figure 4:
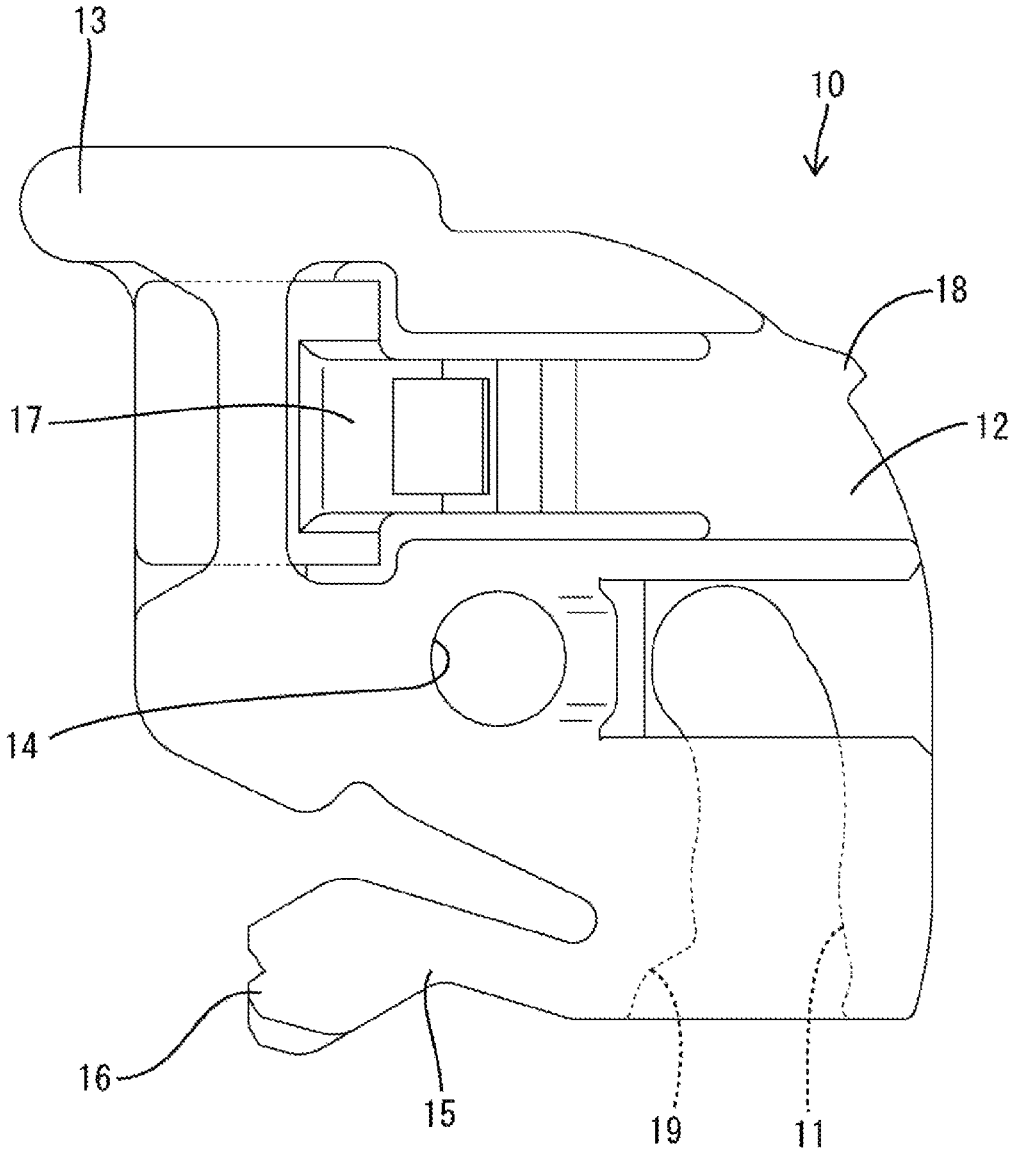
FIG. 4 is a bottom view showing a lever.
Figure 5:
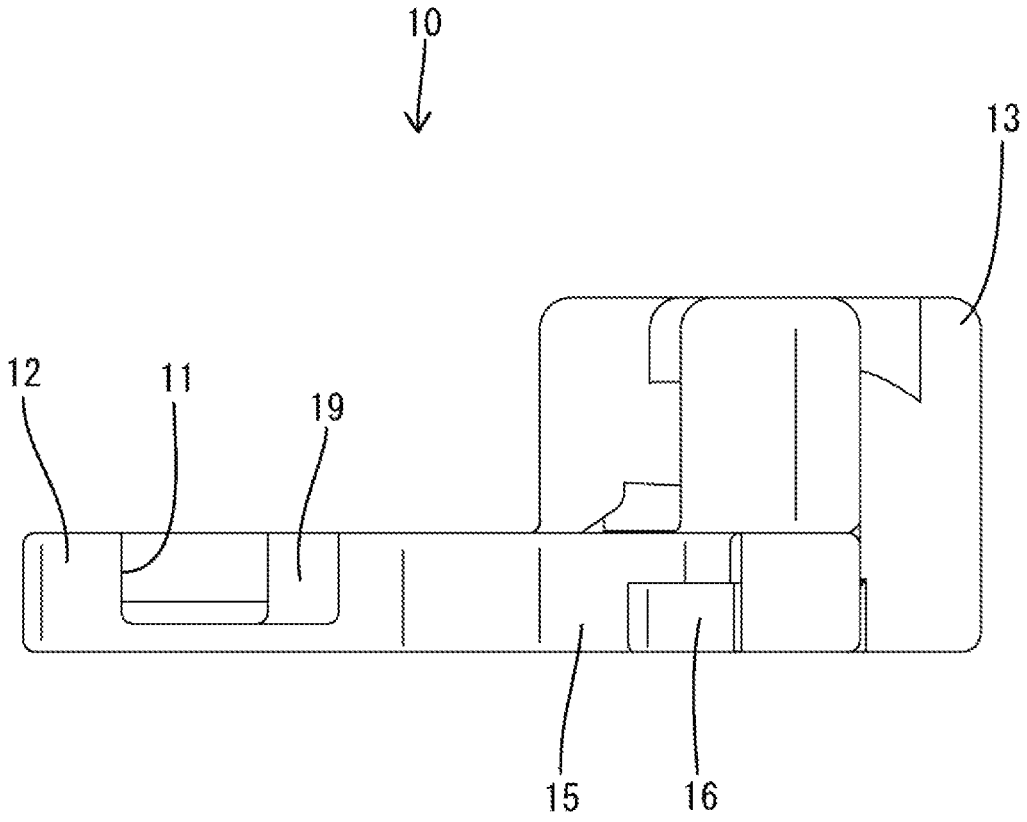
FIG. 5 is a side view showing the lever.

The lever 10 is a rotary lever and includes a thin flat cam plate 12 made of synthetic resin and an operating portion 13 operable by placing the finger thereon for rotating the lever 10, as shown in FIG. 4. The cam plate 12 of the lever 10 is mounted into the lever accommodating portion 22 with a tiny clearance, as shown in FIG. 6, and the operating portion 13 projects back from the lever accommodating portion 22.

As shown in FIG. 4, a substantially circular bearing hole 14 is recessed on the bottom surface of the cam plate 12. An unillustrated supporting shaft projects on the lever accommodating portion 22 of the housing 20 and is fit into this bearing hole 14. The lever 10 is rotatable about the supporting shaft between an initial position shown in FIG. 6 where the lever 10 is held before connection to the mating connector 30 and a connection end position shown in FIG. 9 where proper connection to the mating connector 30 is completed. Note that the lever 10 is provided with a connection lock piece 17 for holding the lever 10 at the connection end position.

Figure 9:
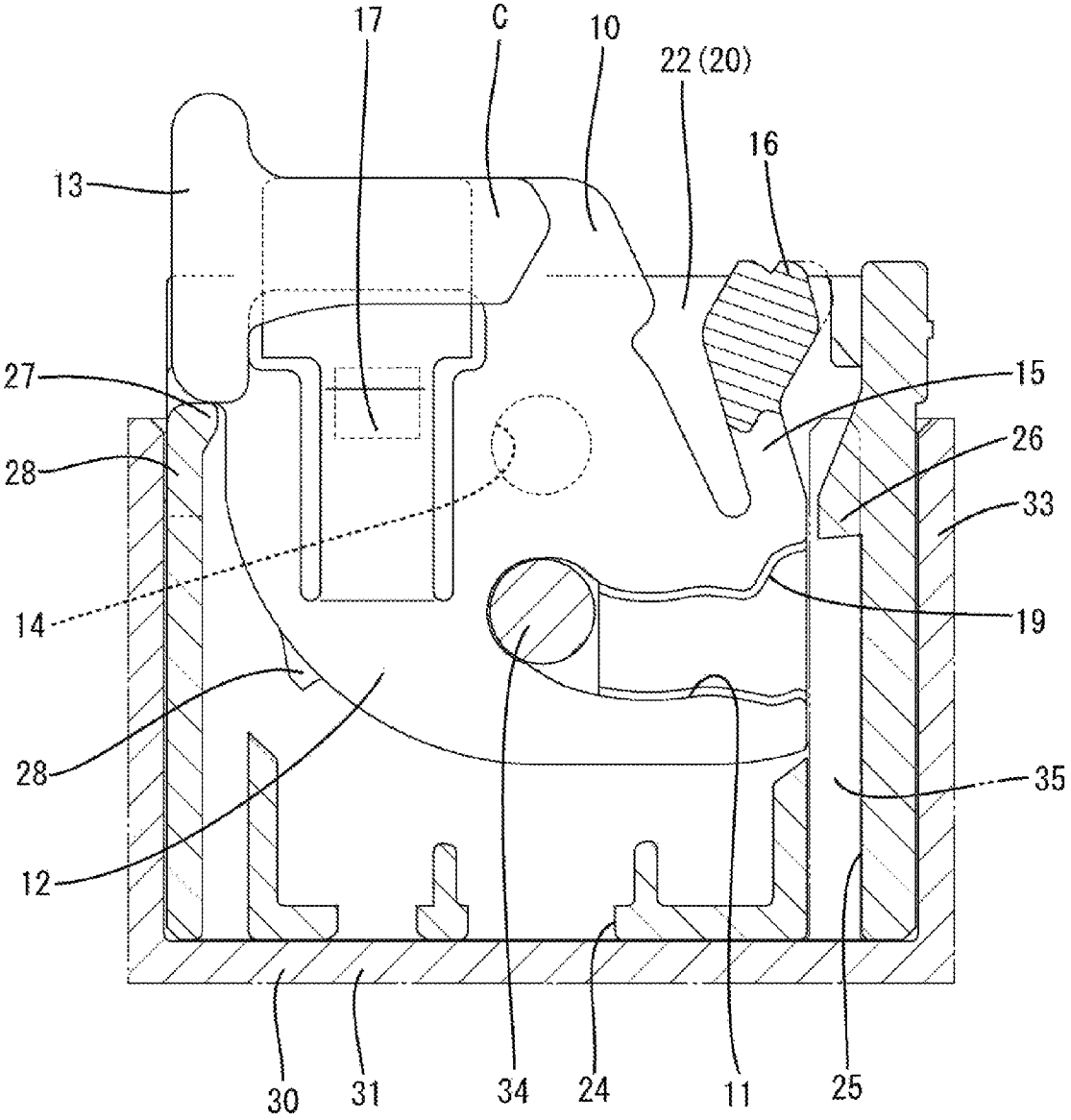
FIG. 9 is a plan view partly in section showing proper connected to the mating connector.

A cam groove 11 is formed on the upper surface of the cam plate 12, as shown in FIGS. 7 to 9, and can be engaged with the cam pin 34 of the mating connector 30. The recess-like cam groove 11 extends from the outer peripheral surface of the cam plate 12 toward a center. When the lever 10 is at the initial position, the entrance of the cam groove 11 is in the first receiving path 24 and the cam pin 34 can be received into the cam groove 11.

An abutting portion 19 is provided near the entrance of the cam groove 11 for abutting against the cam pin 34 if the housing 20 is pushed forward in the connecting direction to the mating connector 30 when the lever 10 is at the initial position. The abutting portion 19 is formed on a side surface of the cam groove 11 and is inclined with respect to an extending direction of the cam groove 11 to be opened out. This causes the entrance of the cam groove 11 to have a larger width than a part behind the entrance. The abutting portion 19 is at substantially a right angle to the front-back connecting direction when the lever 10 is at the initial position.

The connector C is provided with the initial lock L for holding the lever 10 at the initial position (see FIG. 6). The initial lock L includes an initial lock piece 15 provided on the lever 10 and a lock receiving portion 26 provided on the housing 20.

The initial lock piece 15 is cantilevered from the outer peripheral surface of the cam plate 12 and extends in a rotating direction of the lever 10 from the initial position to the connection end position. A base end part of the initial lock piece 15 is located near the entrance of the cam groove 11. A locking portion 16 to be locked to the lock receiving portion 26 is provided on a tip part of the initial lock piece 15.

The lock receiving portion 26 projects into the back of the second receiving path 25 at a position near the rear end of the lever accommodating portion 22. When the lever 10 is at the initial position, the locking portion 16 of the initial lock piece 15 is located in the second receiving path 25 and is locked to the front surface of the lock receiving portion 26 to regulate rotation of the lever 10 toward the connection end position.

The connector C is provided, separately from the initial lock L, with rotation regulating portions S for regulating the rotation of the lever 10 by being held in connect with the lever 10 in the rotating direction of the lever 10 when the lever 10 is at the initial position (see FIGS. 6 and 7). The rotation regulating portions S include a lever-side regulating portion 18 on the lever 10 and a housing-side regulating portion 27 on the housing 20.

The lever-side regulating portion 18 is provided at a position on the cam plate 12 of the lever 10 opposite to the initial lock piece 15 across the bearing hole 14. The lever-side regulating portion 18 projects on the outer peripheral surface of the cam plate portion 12. A front surface of the lever-side regulating portion 18 in the rotating direction of the lever 10 from the initial position to the connection end position is substantially vertical to the outer peripheral surface of the cam plate 12. Further, a rear surface of the lever-side regulating portion 18 is inclined to gradually increase a projecting distance from the rear toward the front in the rotating direction.

The housing-side regulating portion 27 projects in on a side wall of the lever accommodating portion 22. The housing-side regulating portion 27 is located on a course of the lever-side regulating portion 18 when the lever 10 is rotated. The rear surface of the housing-side regulating portion 27 is substantially perpendicular to the front-back direction.

A part of the side wall of the housing 20 where the housing-side regulating portion 27 projects defines a resilient displacing portion 28 that is resiliently displaceable in the lateral direction in FIG. 6. The resilient displacing portion 28 is separated from the other part of the side wall of the housing 20 by slits 29 formed above and below, as shown in FIG. 2, and is cantilevered from front to back. The housing-side regulating portion 27 is provided on a rear end part of the resilient displacing portion 28, as shown in FIG. 6. The resilient displacing portion 28 is arranged so as not to project from the side surface of the housing 20 in a natural state.

The connector C is connected to the mating connector 30 by first setting the lever 10 at the initial position (see FIG. 6). When the lever 10 is at the initial position, the initial lock L is in a functioning state. At this time, the lever-side regulating portion 18 and the housing-side regulating portion 27 are facing each other (separated) in the rotating direction of the lever 10.

Subsequently, the connector C is fit into the receptacle 33 of the mating connector 30 (see FIG. 7). Thus, the cam pin 34 enters the entrance of the cam groove 11 from the first receiving path 24 and the abutting portion 19 of the cam groove 11 and the cam pin 34 abut against each other in the front-back direction. Further, the lock releasing portion 35 enters from the second receiving path 25 and presses the initial lock piece 15 in an unlocking direction to resiliently displace the initial lock piece 15. In this way, the locking portion 16 is disengaged from the lock releasing portion 35 to release a locked state and a rotating operation of the lever 10 at the initial position is allowed. The lever 10 slightly rotates during this release of the initial lock L. Thereafter, the lever-side regulating portion 18 and the housing-side regulating portion 27 are brought into contact with each other.

An operator may strongly push the rear surface of the housing 20 in an effort to push the connector C into the receptacle 33 of the mating connector 30 without rotating the lever 10. However, the cam pin 34 abuts against the abutting portion 19 of the cam groove 11 in the front-back direction to preventing a pushing movement of the housing 20. Further, the lever-side regulating portion 18 and the housing-side regulating portion 27 contact each other in the rotating direction to regulate rotation of the lever 10. The connection does not proceed and the lever 10 also does not rotate even if the rear surface of the housing 20 is pushed. Thus, an operator will not mistakenly assume that the connecting operation has been completed, and realizes that the connector C cannot be connected to the mating connector 30 unless the lever 10 is rotated.

If the operator tries to rotate the lever 10 toward the connection end position by pressing the operating portion 13 of the lever 10, a contact force between the lever-side regulating portion 18 and the housing-side regulating portion 27 increases and the resilient displacing portion 28 of the housing 20 is displaced resiliently out, the housing-side regulating portion 27 is retracted outward and a rotation regulating state of the rotation regulating portions S is released as shown in FIG. 8.

When the operator rotates the lever 10, the lever-side regulating portion 18 passes through the inner side of the housing-side regulating portion 27 and the resilient displacing portion 28 resiliently returns to an initial posture. Further, the cam pin 34 disengages from the abutting portion 19 and the connector C is pulled toward a mating side by a cam action by the engagement of the cam pin 34 and the cam groove 11. Thus, the connector C is fit further into the receptacle 33.

When the lever 10 reaches the connection end position, as shown in FIG. 9, the connector C is connected properly to the mating connector 30 and the connection lock piece 17 of the lever 10 is locked to the housing 20 to regulate the rotation of the lever 10 toward the initial position. In this way, the operation of connecting the connector C to the mating connector 30 is completed.

The connector C of this embodiment has a lever 10 with a cam groove 11 to engage the cam pin 34 on the mating connector 30. The lever 10 is mounted rotatably on the housing 20 and the initial lock L holds the lever 10 at the initial position. However, the initial lock L is released to enable rotation of the lever 10 when the connector C is connected lightly to the mating connector 30. The lever 10 then is rotated from the initial position to the connection end position to connect the connector C properly to the mating connector 30. Rotation regulating portions S are provided on the lever 10 and the housing 20 separately from the initial lock L, and contact each other in the rotating direction of the lever 10 when the lever 10 is at the connection end position to regulate rotation of the lever 10. Additionally, the abutting portion 19 is near the entrance of the cam groove 11 and abuts against the cam pin 34 if the housing 20 is pushed forward in the connecting direction to the mating connector 30 when the lever 10 is at the initial position.

According to this configuration, the initial lock L is released when the connector C is connected temporarily to the mating connector 30. However, the abutting portion 19 of the cam groove 11 abuts against the cam pin 34 to prevent the housing 20 from being pushed farther toward the mating connector 30, and the rotation regulating portions S regulates rotation of the lever 10 if the housing 20 is pushed in the connecting direction after the connector C is connected temporarily to the mating connector 30. Thus, it is possible to prevent the operator's misunderstanding that the operation of connecting the connector C to the mating connector 30 has been completed.

Further, the lever 10 rotates slightly upon release of the initial lock L. The rotation regulating portions S are separated when the initial lock L is activated and are brought into contact with each other after the rotation of the lever 10 accompanying the release of the initial lock L. Accordingly, it is possible to prevent a rotational force of the lever 10 accompanying the release of the initial lock L from acting on the rotation regulating portions S.

Further, the rotation regulating portion S on the side of the housing 20 is displaced resiliently due to an increase of a contact force, thereby releasing a state where the rotation of the lever 10 is regulated. Thus, the state where the rotation of the lever 10 is regulated is released by an increase of a force for rotating the lever 10. This releasing operation and the rotating operation of the lever 10 can be performed as a series of operations.

The invention is not limited to the above described and illustrated embodiment. For example, the following embodiments are also included in the scope of the invention.

Although plural connectors C are connected to the mating connector 30 in the above embodiment, there is no limitation to this. For example, the invention can be applied to a connector assembly in which a mating connector and a connector are connected one-to-one.

The mating connector 30 is a board connector in the above embodiment. However, the invention can be applied in cases where a mating connector is other than a board connector.

The abutting portion 19 is arranged substantially at a right angle to the front-back direction (connecting direction) when the lever 10 is at the initial position in the above embodiment. However, the inclination of the abutting portion does not matter as long as the abutting portion can abut against the cam pin in the front-back direction. For example, the abutting portion may be slightly inclined so that the back side end of the cam groove is more forward than the entrance.

Although the part of the side wall of the housing 20 where the housing-side regulating portion 27 is provided serves as the resilient displacing portion 28 in the above embodiment. However, the part of the side wall of the housing 20 where the housing-side regulating portion 27 is provided may not be resiliently displaceable.

Although the part of the side wall of the housing 20 where the housing-side regulating portion 27 is provided serves as the resilient displacing portion 28 in the above embodiment, a part where the lever-side regulating portion is provided may be resiliently displaceable.

The lever-side regulating portion 18 is provided on the outer peripheral surface of the cam plate 12 in the above embodiment, but there is no limitation to this. For example, the lever-side regulating portion may be on the upper or lower surface of the cam plate and the housing-side regulating portion may be on the upper or lower surface of the lever accommodating portion.

Although both the lever-side regulating portion 18 and the housing-side regulating portion 27 are projections in the above embodiment, there is no limitation to this. For example, one regulating portion may be a projection and the other regulating portion may be a recess.

The lever 10 slightly rotates upon release of the initial lock L in the above embodiment. However, the lever may not rotate accompanying the lock release.

Although the respective rotation regulating portions S are separated when the initial lock L is activated and come into contact with each other after the rotation of the lever 10 accompanying the release of the initial lock L is completed in the above embodiment, there is no limitation to this. The rotation regulating portions may contact each other already when the initial lock is activated.

LIST OF REFERENCE SIGNS

C connector
L initial lock
S rotation regulating portion
10 lever
11 cam groove
19 abutting porton
20 housing
30 mating connector
34 cam pin

What is claimed is:

1. A lever-type connector, comprising:

a housing configured for connection with a mating connector along a connecting direction;

a lever mounted to the housing for rotation between a first initial position and a connection end position, the lever including a cam groove to be engaged with a cam pin provided on the mating connector, the cam groove being configured to connect the housing and the mating connector in response to rotation of the lever;

an initial lock having a first resiliently deflectable component at one of the housing and the lever for releasably holding the lever at the first initial position;

a rotation regulating portion having a lever-side regulating portion on the lever and a housing-side regulating portion on the housing, one of the lever-side regulating portion and the housing-side regulating portion defining a second resiliently deflectable component configured to achieve releasable contact between the lever-side regulating portion and the housing-side regulating portion for regulating the rotation of the lever in a rotating direction of the lever when the lever is at a second initial position beyond the first initial position; and an abutting portion projecting into the cam groove near an entrance of the cam groove and aligned substantially transverse to the connecting direction when the lever is at the first and second initial positions for abutting against the cam pin and preventing rotation of the lever if the housing is pushed in the connecting direction to the mating connector when the lever is at the first or second initial position.

2. The lever-type connector of claim 1, wherein:

the lever slightly rotates accompanying release of the initial lock; and the lever-side rotation regulating portions and the housing-side rotation regulating portion are spaced apart from one another when the initial lock is holding the lever at the first initial position and the lever-side regulating portion and the housing-side regulating portion contact each other after rotation of the lever to the second initial position.

3. The lever-type connector of claim 1, wherein the second resiliently deflectable component of the rotation regulating portion on the housing or on the lever is resiliently displaced by an increase of a contact force by a rotating operation of the lever, thereby releasing the lever for rotation to the connection end position.

4. The lever-type connector of claim 1, wherein the housing has a front end and opposed first and second sidewalls extending rearward from the front end, initial lock defines a releasable engagement between the lever and the first side wall of the housing.

5. The lever-type connector of claim 4, wherein the initial lock comprises a resiliently deflectable lock piece formed on the lever and a lock receiving portion formed on the first side wall of the housing.

6. The lever-type connector of claim 5 wherein the housing-side regulating portion is the second resiliently deflectable component.

7. The lever-type connector of claim 4 wherein the housing-side regulating portion is on the second side wall of the housing and is the second resiliently deflectable component.

8. The lever-type connector of claim 1, wherein the abutting portion is disposed and configured to translate laterally of the cam pin when the lever is rotated from the second initial position in a direction toward the connection end position.

* * * * *